United States Patent [19]

Biesel

[11] 4,074,684

[45] Feb. 21, 1978

[54] DRAIN SYSTEM FOR PROTECTING BUILDINGS AGAINST FLOODING AND METHOD

[76] Inventor: John W. Biesel, 3139 Taylor Drive, Jeffersonville, Ind. 47130

[21] Appl. No.: 716,543

[22] Filed: Aug. 23, 1976

[51] Int. Cl.[2] ..... E03F 1/00

[52] U.S. Cl. ..... 137/1; 52/169.5; 137/362; 137/593

[58] Field of Search ..... 137/362, 593, 1; 52/368, 369.5

[56] References Cited

U.S. PATENT DOCUMENTS

| | | | |
|---|---|---|---|
| 1,577,039 | 3/1926 | Lafin | 137/593 |
| 1,762,190 | 6/1930 | Noe | 137/362 |
| 2,049,340 | 7/1936 | Van der Horst | 137/362 |
| 2,327,602 | 8/1943 | Kesteloot | 137/593 X |
| 2,517,195 | 8/1950 | Gaspar | 137/593 X |
| 3,229,707 | 1/1966 | Suchan | 137/362 X |

*Primary Examiner*—Robert G. Nilson
*Attorney, Agent, or Firm*—Maurice L. Miller, Jr.

[57] ABSTRACT

A system and method for protecting a building against flooding caused by the overflow of a liquid from a liquid drain line into the building to which the drain line is connected. A floor drain, connected to a drain line, is connected in a watertight manner to a vessel having a hollow interior which rises a preselected distance above the floor drain to permit a liquid overflowing the floor drain to rise in the vessel. The vessel is vented to atmosphere a preselected distance above the floor drain to permit liquid in the hollow interior to recede through the floor drain as the overflow subsides. The vessel may contain a drain hole therein near the floor which can be selectively opened or closed to permit a liquid on the floor to be drained through the floor drain. The vessel employed may be a conventional ceiling supporting column. The vessel may be vented through a vent line which communicates with the atmosphere outside of the building to prevent the escape of odors from the vessel inside of the building and to provide additional liquid overflow protection. A ceiling supporting column may form the vessel.

11 Claims, 5 Drawing Figures

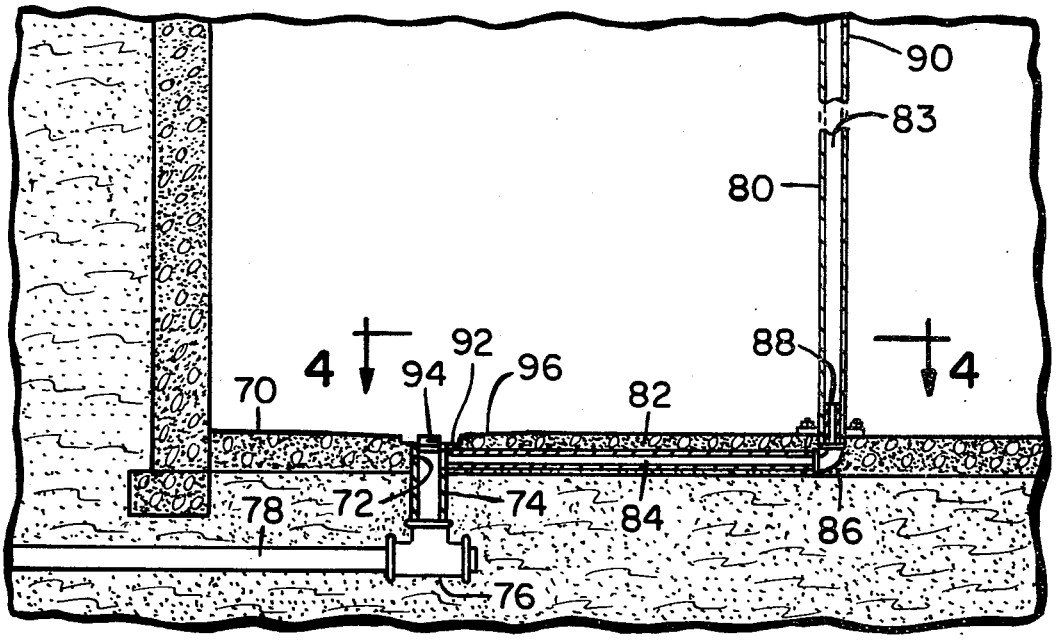
Fig. 3
Fig. 4
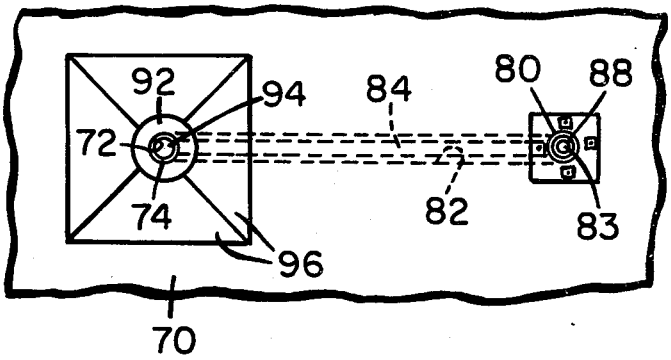
Fig. 5
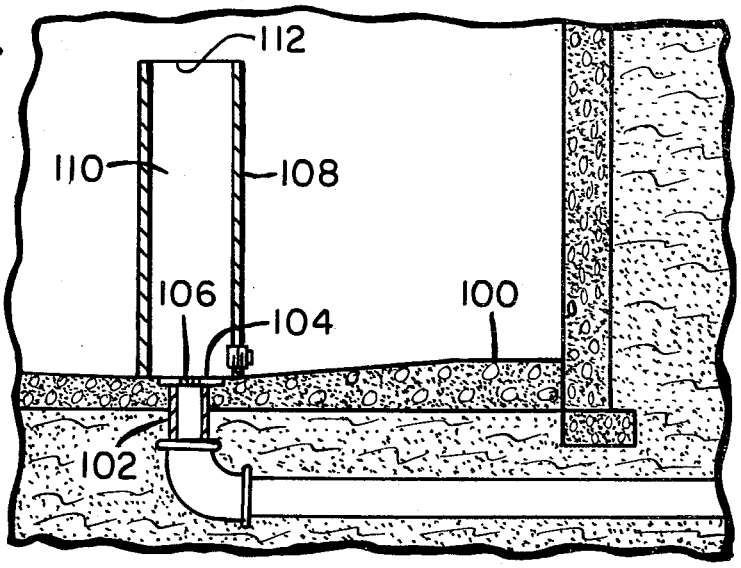

DRAIN SYSTEM FOR PROTECTING BUILDINGS AGAINST FLOODING AND METHOD

BACKGROUND OF THE INVENTION

One of the problems which has existed in buildings known in the prior art, especially in apartment buildings, single family dwellings, and otherwise, where basements are provided, is that sewer drain lines which open onto the basement floor tend to become stopped up or overflow from time to time thus causing the basement to flood through the drain line.

Where such problems tend to occur, expensive sump pumps are often resorted to, to pump flooded basements free of storm water, sewage and the like. Moreover, since the sump pump is usually employed relatively infrequently, the pump may be found to be inoperative at a time when it is needed, thus adding additional expense and delay to the clearing of flooded basements.

By means of my invention these problems are substantially overcome, sometimes eliminating the need for a basement sump pump altogether. Furthermore, my invention not only substantially eliminates flooding caused by drain line back up, it permits the use of a drain opening to wash the floor in the usual manner when desired. My system is particularly advantageous because it may utilize a conventional and often used basement main beam metal supporting column, having a hollow interior, as a basement flooding protective device. Because this type of ceiling supporting column may be employed routinely in building construction for ceiling support, its additional use in the manner provided by my invention further minimizes the costs of materials required.

BRIEF DESCRIPTION OF THE DRAWINGS

FIG. 3 shows a cross-sectional elevation view of a conventional basement drain system which has been modified in accordance with my invention, thus illustrating another preferred embodiment thereof.

FIG. 4 shows a plan view of the modified basement drain system of FIG. 3 as viewed along lines 4—4 of the latter Figure.

FIG. 5 shows a cross-sectional elevation view of a drain system for protecting buildings against flooding, thus illustrating in another preferred embodiment thereof, the broad principal of my invention.

SUMMARY OF THE INVENTION

It is an object of my invention to provide a system for protecting a building against flooding caused by sewer or drain line overflow.

It is a further object of my invention to provide such a system utilizing a ceiling supporting column having a hollow interior as a portion thereof.

It is yet another object of my invention to provide such a system at low costs utilizing standard materials, at least some of which would otherwise be in use in a building for other purposes.

It is still another object of my invention to provide such a system while providing means for draining liquid from the building floor into a sewer drain line as when it is desired to clean the floor.

It is also an object of my invention to provide air venting means for the ceiling supporting column used in my system to minimize the escape of odors and other gases from a sewer drain line into the building in which the system is employed.

Briefly, in accordance with my invention, there is provided a system for protecting a building against flooding caused by the overflow of a liquid from a liquid drain line into the building to which the drain line is connected. Specifically, a means is provided for draining a floor of a liquid, which is connected to a liquid drain line. A vessel defining a hollow interior is provided which rises a preselected distance above the floor draining means. The floor draining means communicates with the hollow interior in a substantially watertight manner, for permitting the liquid overflowing the floor draining means to rise in the hollow interior. A means is provided for venting the hollow interior at a preselected vertical distance above the floor draining means for permitting the liquid to recede from the hollow interior through the floor draining means as the overflow subsides.

These and other objects of my invention will become apparent to those skilled in the art from the following detailed description and attached drawings on which, by way of example, only the preferred embodiments of the subject invention is illustrated.

DESCRIPTION OF THE PREFERRED EMBODIMENTS

Figure 1:
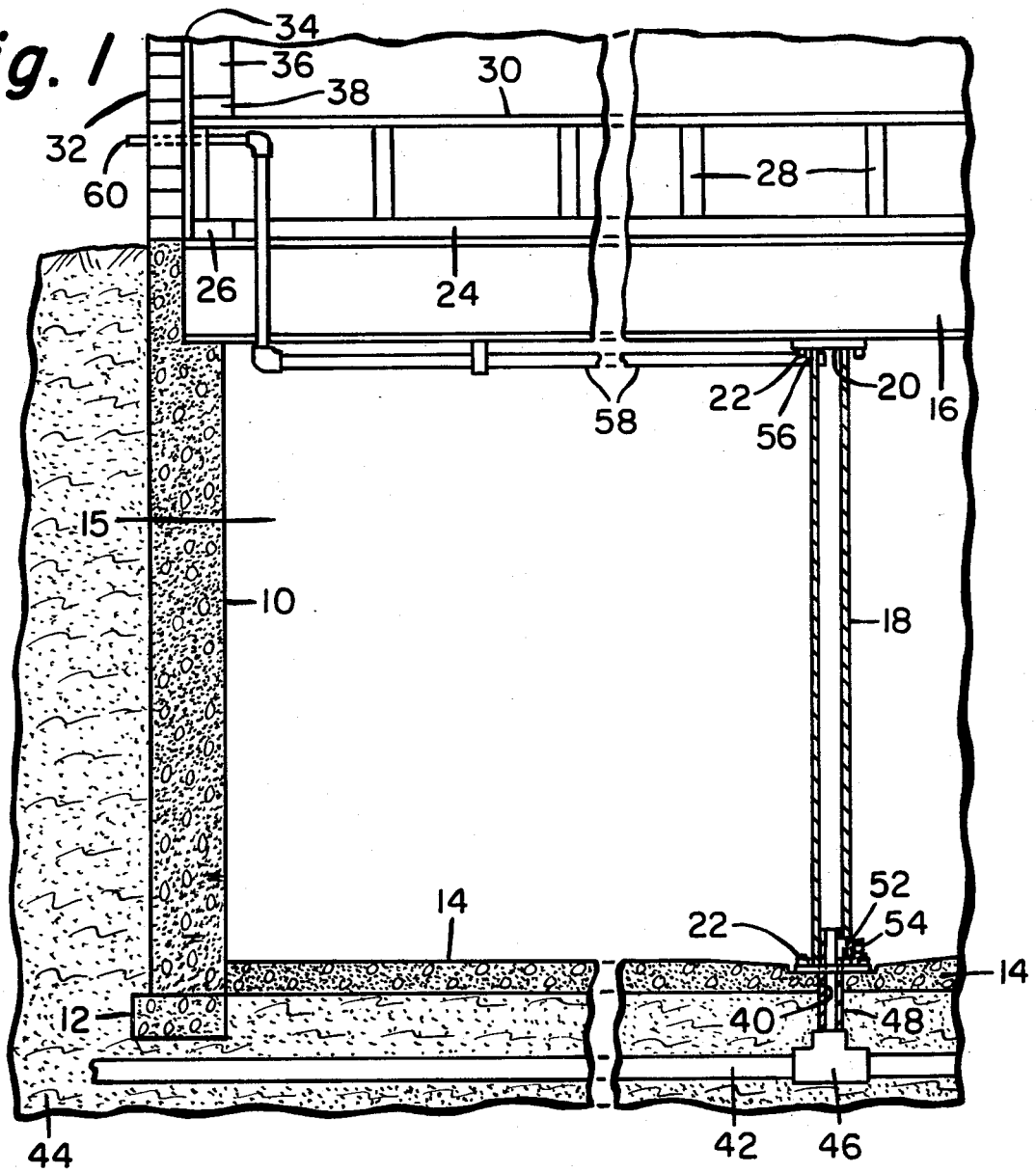
FIG. 1 shows a cross-sectional elevation view of a portion of a typical building basement structure containing a system for protecting the building against flooding caused by sewer or drain line overflow or back pressure, thus illustrating one preferred embodiment of my invention.
Figure 2:
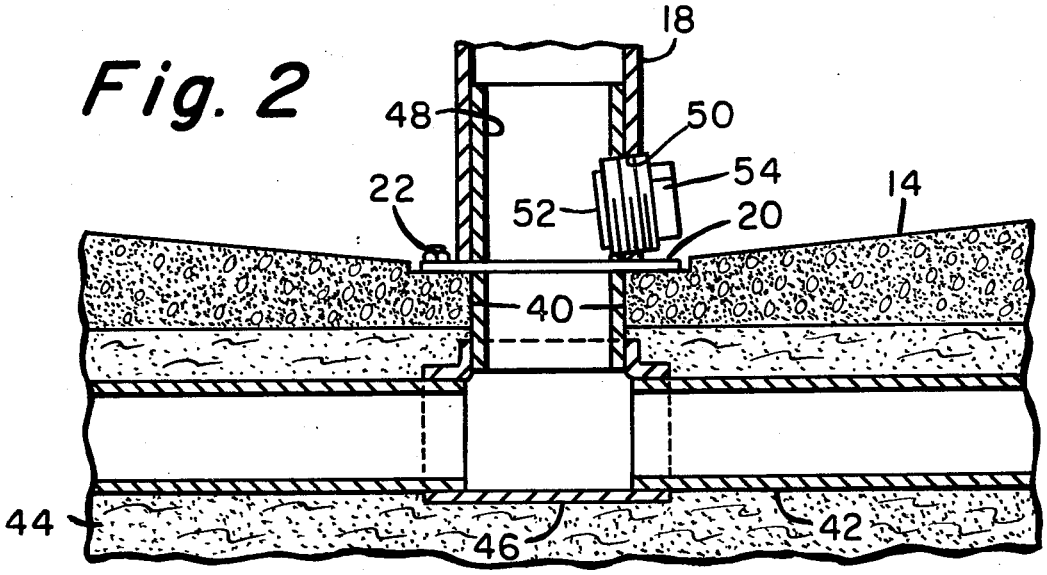
FIG. 2 shows an enlarged cross-sectional elevation view of a preferred drain line connection with the system of my invention as shown in FIG. 1.

Referring now to FIGS. 1 and 2 there is shown, in one preferred embodiment of the subject invention, a basement sewer drain system for a dwelling or other building. For illustrative purposes only, a typical single family residential basement structure is shown including a concrete wall 10, resting upon a concrete foundation 12, and a concrete basement floor 14. A basement 15 is thus formed. The main floor supporting beam for such construction commonly consists of a steel I-beam 16 of usual and well-known construction, which is supported at its ends by opposite walls 10 and intermediate its ends by one or more hollow steel supporting columns 18 having flanged ends 20. The columns 18 are usually circular in cross-section. The flanges 20 are usually square shaped as viewed along the longitudinal axis of the column and provide means for bolting the column 18 securely between the floor 14 and the I-beam 16 with suitable threaded fasteners 22. It is also common practice in home construction to find 3–2 × 10 inch wood boards nailed together and used in place of the I-beam of the subject example to form the main floor beam.

In common home construction practice, a 2 × 4 inch wood plate 24 is supported along the central portion of the I-beam 16 and spans the length of the beam 16 between 2 × 4 inch wood plates 26 which follow along and above an inside portion of the outer wall 10. The plates 24 and 26, in turn, support a series of 2 × 10 inch wooden floor supporting beams 28, usually spaced about 18 inches apart. A first floor 30 which may consist of plywood is supported above the beams 28. The outside walls of the house may consist of any well-known material such as brick veneer 32 supported by an outside portion of the wall 10. Next to the brick veneer 32 is a weatherboard 34 of well-known type, against which wooden wall studs 36 of the first floor abut. Typically, these wall studs 36 are supported by yet another 2 × 4 inch wooden plate 38.

In accordance with my invention, I provide a basement drain opening 40 through the concrete floor 14 directly under the bottom end of at least one of the hollow supporting columns 18. A basement sewer drain line 42 of any suitable type is disposed in the earth 44 beneath the concrete basement floor 14 and communicates with the hollow interior of the column 18 through a standard T-joint 46, elbow joint or other connection, and a vertical connecting pipe 48. The pipe 48 should have an outside diameter suitable to fit the inside diameter of the supporting column 18 in a snug and reasonably watertight manner. The drain line 42 carries storm water and/or sewage away from the house to the usual public sewer lines, not shown.

A hole 50 (FIG. 2 only) is provided through the column 18 and connecting pipe 48 near the base of the column 18 above the bottom flange 20. The hole 50 is threaded to receive a suitable removable threaded plug 52 so that the hole 50 may be readily sealed in a watertight manner when desired. The plug 52 may include a bolt head 54 suitable for turning by means of a wrench or other tool so as to permit tightening or loosening of the plug 52. The basement floor 14 may be drained of liquid as when flooded or following washing thereof, by removing the plug 52 from the hole 50. The concrete floor 14 may be tapered slightly in an area around the base of the column 18 to facilitate this purpose, as is commonly done around conventional basement floor drain systems well known in the art.

Otherwise, when not draining the basement floor 14, the plug 52 is maintained in the hole 50 in a watertight manner. Should a severe storm or flood condition occur that would tend to back water or sewage up into the home, such water or sewage will back up into the hollow interior of the supporting column 18 so as not to flood the basement floor 14.

Near the top of the column 18, a vent hole 56 (FIG. 1 only) should be drilled through the column wall to allow air to flow into the top of the column 18 so that liquid standing in the column 18 can recede into the drain line 42 and back to the sewer, not shown, when the flood condition or sewer line impairment that caused the liquid back up, ceases. In the alternative, especially where high rising water can be expected to occur in the basement, as where the basement is low in a flood plane for example, a vent line 58 may be installed between the vent hole 56 and the ambient atmosphere above ground and outside the building, as for example, at 60. The vent line 58 then serves three important purposes. First, it provides vent air to the interior of the column 18 so as to permit standing water in the column 18 to recede as previously explained. Secondly, by venting from the hole 56 to the outside of the building, as at 60, noxious odors and fumes from the sewer will not escape into the basement 15 to possible contaminate the rest of the house. Thirdly, in the event of heavy flooding wherein sewer water might back up into the column 18 to the full height thereof, excess liquid from the column 18 will be expelled from the house through the vent line 58. In an extreme case, of course, the vent line 58 could be extended up the wall 34 between the wall studs 36 to the roof top, not shown, if desired.

Now referring particularly to FIG. 2, it will be noted that the hole 50 may be drilled through the column 18 and connecting pipe 48 on an incline, relative to the horizontal portion of the floor 14, so that the bolt head 54 will clear the tapered portion of the floor sufficiently to allow use of a tool, not shown, to adjust the plug 52, where such clearance between the tool and the tapered portion of the floor 14 would otherwise be insufficient. By means of my invention the use of an expensive sump pump to drain basements is eliminated. In the alternative, a conventional one-way check valve of suitable type could be employed in place of the removable plug 52, thus eliminating the need for opening and closing the drain hole 50 with a tool.

Referring now to FIGS. 3 and 4 there is shown a conventional basement drain system modified in accordance with the principals of my invention. A concrete floor 70 defines a drain hole 72 containing a drain pipe 74. The drain pipe 74 is connected to a coupling 76 which is, in turn, connected to a liquid drain line 78 for the purpose of draining the floor 70 of liquid in the usual well-known manner. The basement ceiling, not shown, is braced by a conventional metal supporting column 80 in the usual manner. In older homes already in existence, the column 80 is supported by the floor 70 at a position remote and spaced from the drain hole 72. The system of my invention can readily be provided in such older buildings, simply by providing a temporary jack pole or brace disposed between the ceiling, not shown, and the floor 70 to carry the weight of the beam being supported by the column 80, after which the column 80 is removed so as to expose the floor 70 directly beneath it. Next, with the column 80 removed, a channel 82 is formed in the floor 70 between the drain pipe 74 and the area of the floor directly under the point where the hollow interior 83 of the column 80 was located before removal. A pipe 84 is disposed in the channel 82, preferably below the top of the floor 70, and is connected on one end to the drain pipe 74. The other end of the pipe 84 may be connected to an elbow 86 which is, in turn, connected to a riser pipe 88, preferably of a diameter sufficient to fit within the hollow interior 83 in a snug and watertight manner when the column 80 is replaced. Thereafter, the column 80 is placed back in its original position as shown. A vent port 90 is drilled in the column 80 near the top thereof to provide suitable means for venting the hollow interior 83 of the column 80 for permitting a liquid standing below it in the column 80 to recede therefrom and through the pipe 84 and drain pipe 74 when the overflow condition which causes a liquid to back up into the column 80 subsides. In such an arrangement it is necessary to remove the usual drain plate, not shown, that would ordinarily be disposed in the floor over and around the drain pipe 74, at area 92, and replace the same with a suitable plug 94 to plug the drain pipe 74 in a substantially watertight manner. The plug 94 may be removable to permit draining the floor 70 of a liquid as, for example, after washing the same. For illustrative purposes, a tapered section 96 of the floor 70 surrounding the drain pipe 74 is shown.

Referring now to FIG. 5 there is shown another preferred embodiment of my invention, which illustrates the broad principal of my invention, including a floor 100 containing a means for draining the floor 100, for example a drain pipe 102. Over the pipe 102 there rests a drain plate 104 containing drain holes 106 therethrough. Surrounding this conventional drain assembly is a vessel 108 defining a hollow interior 110 in which a liquid may rise as it overflows from and backs up out of the drain pipe 102. The height of the hollow interior 110 above the drain pipe 102 should be preselected so as to at least equal the highest overflow condition of liquid from the pipe 102 that can reasonably be expected to occur. A means for venting the hollow interior 110 of the vessel 108 must be provided, such as an open end 112 at the top of the vessel 108, to permit a column of liquid standing in the same to recede into the drain pipe 102 when the overflow condition subsides.

Although the subject invention has been described with respect to specific details of certain preferred embodiments thereof, it is not intended that such details limit the subject invention except insofar as set forth in the following claims.

I claim:

1. A system for protecting a building against flooding caused by the overflow of a liquid from a liquid drain line into said building to which said drain line is connected comprising means for draining a floor of a liquid, connected to a liquid drain line, a ceiling supporting column defining a hollow interior which rises a preselected distance above said floor draining means, said floor draining means communicating with said hollow interior in a substantially watertight manner, for permitting a liquid overflowing said floor draining means to rise in said hollow interior, and means for venting said hollow interior at a preselected vertical distance above said floor draining means for permitting said liquid to recede from said hollow interior through said floor draining means as said overflow subsides.

2. The system of claim 1 further comprising means for selectively opening said floor draining means to said floor to permit the draining of a liquid from said floor through said floor draining means.

3. The system of claim 2 wherein said opening means comprises a drain hole defined by said vessel near the level of said floor draining means, and means for selectively plugging said drain hole in a substantially watertight manner.

4. The system of claim 3 wherein said plugging means comprises a threaded plug adapted to threadably connect in said drain hole.

5. The system of claim 3 wherein said plugging means is inclined in said drain hole relative to a horizontal portion of said floor for providing clearance between said plugging means and said floor for adjusting said plugging means with a tool.

6. The system of claim 1 wherein said ceiling supporting column is supported on one end by said floor and surrounds said floor draining means in a substantially watertight manner.

7. The system of claim 1 further comprising means connected between said floor draining means and said column for conveying a liquid between said drain line and said hollow interior, said column being supported one one end said floor remote from said floor draining means.

8. The system of claim 1 further comprising a vent pipe connected to said venting means and connected to ambient atmosphere outside of said building.

9. A method for protecting a building against flooding caused by the overflow of a liquid from a liquid drain line into said building to which said drain line is connected, the steps of which comprise providing means for draining a floor of a liquid, connecting in a watertight manner said floor draining means to a ceiling supporting column defining a hollow interior which rises a preselected distance above said floor draining means, and venting said hollow interior at a preselected vertical distance above said floor draining means to permit said liquid to recede from said hollow interior through said floor draining means as said overflow subsides.

10. The method of claim 9, the steps of which further comprise providing means for selectively opening said floor draining means to said floor to permit the draining of a liquid from said floor through said floor draining means.

11. In an improved system for protecting a building against flooding caused by the overflow of a liquid from a drain line into said building to which said drain line is connected of the type comprising a floor defining a drain hole therethrough, and a drain line communicating with said drain hole, the improvement of which comprises a ceiling supporting column defining a hollow interior which rises a preselected distance above said floor, said drain hole communicating with said hollow interior in a substantially watertight manner, and means for venting said hollow interior to atmosphere a preselected distance above said floor.

* * * * *